US006129587A

United States Patent [19]

Huang

[11] Patent Number: 6,129,587

[45] Date of Patent: Oct. 10, 2000

[54] ULTRA LOW PROFILE ELECTRICAL CONNECTOR ASSEMBLY

[75] Inventor: Wayne Huang, Alhambra, Calif.

[73] Assignee: Hon Hai Precision Ind. Co., Ltd., Taipei Hsien, Taiwan

[21] Appl. No.: 09/427,828

[22] Filed: Oct. 27, 1999

Related U.S. Application Data

[63] Continuation-in-part of application No. 09/404,441, Sep. 22, 1999.

[51] Int. Cl.[7] ..... H01R 13/648

[52] U.S. Cl. ..... 439/607

[58] Field of Search ..... 439/607–610, 439/676

[56] References Cited

U.S. PATENT DOCUMENTS

| | | | |
|---|---|---|---|
| 5,718,605 | 2/1998 | Morikawa et al. | 439/607 |
| 5,807,137 | 9/1998 | Janota et al. | 439/607 |
| 5,924,890 | 7/1999 | Morin et al. | 439/607 |
| 5,934,940 | 8/1999 | Maranto et al. | 439/607 |
| 5,934,941 | 8/1999 | Hirai et al. | 439/609 |

*Primary Examiner*—Gary F. Paumen
*Attorney, Agent, or Firm*—Wei Te Chung

[57] ABSTRACT

An ultra lower profile electrical connector for electrical connection with an external plug connector includes a conductive shell, an insulative housing and a plurality of contacts. The housing is integrally and directly molded to the shell so that a planar portion of the shell is located flush with a plane as an outermost top surface of the housing, instead of a top wall. Several holder sections formed on the housing each have a least thickness only enough to efficiently lock with a latch of the external plug connector. Therefore, the profile of the entire connector assembly can be lowered more. Also, the connector assembly is suitable for a thin electrical card by means of integrally and directly molding the housing of the connector assembly to a shell for shielding the electrical card.

1 Claim, 10 Drawing Sheets

ULTRA LOW PROFILE ELECTRICAL CONNECTOR ASSEMBLY

This application is a continuation-in-part of U.S. patent application Ser. No. 09/404,441 filed on Sep. 22, 1999.

BACKGROUND OF THE INVENTION

1. Field of the Invention

The present invention relates to an electrical connector assembly, and more particularly to an ultra low profile electrical connector assembly of which an insulative housing integrally formed with a shielding shell.

2. Description of the Prior Art

EIA, Electrical Industries Association, releases a Standards Proposal No. 3652-A, Proposed New Specification "Detail Specification for Trapezoidal Shielded Connector 0.8 mm Pitch Used with Very High Density Cable Interconnect (VHDCI)". According to FIG. 10 on page 10, two trapezoidal shielded female connectors are stacked in a mirror-image arrangement. In addition, the trapezoidal mating portions are not located centrally with respect to their housing. In FIG. 40 on page 29, a male connector mated to the female connectors is shown. In order to have two male connectors fit to the stacked female connectors, the island and the shroud portions are offset from a central line thereof.

U.S. Pat. Nos. 5,761,805 and 5,766,033 issued to Guyer and Davis disclose method for making a high-density and high-density connector, respectively. The connectors disclosed meet the requirements set in the above mentioned Standards. After the connector housing (12) is terminated with conductive wires (24, 22), an over-molding process will be performed to enclose a plastic layer over the connector housing (12). Since the mating portion (14) is offset arranged, the bottom wall (64) of the shell member (14) will become a critical point during the over-molding process.

According to the actual practice, for the reason of easy molding the thickness of the plastic layer (P) over the bottom wall (64) of the shell member (14) shall at least for 1.00 mm, as shown in FIG. 1. This also provides enough rigidity to sustain external impact. However, when the bottom wall (64) of the shell member (14) is offset to accommodate the connector housing (12), the plastic layer deployed over the bottom wall (64) is reduced to 0.6 mm rendering the over-molding process over the bottom wall (64) becomes extremely difficult in light of the plastic flow within such a tiny gap between the bottom wall (64) and an inner wall of the mold cavity, as shown in FIG. 2. In order to inject the molten plastic through the 0.6 mm gap, injection pressure have to increase and the manufacturing cost is increased inevitably. In addition, even the thin layer is finally formed, it is vulnerable to external impact and can not provide any protection. Many efforts have been applied to overcome this problem and none of them is acceptable.

U.S. patent application Ser. No. 09/404,441 filed on Sep. 22, 1999 by the same assignee as the instant application, discloses that an upper and lower metallic shells are integrally molded with an upper and lower plastic covers of a connector wherein at least a portion of one of the upper and lower shells protruding over the corresponding cover. The instant application is a continuation-in-part of the U.S. patent application Ser. No. 09/404,441, which adopts the similar principle to lower the profile/height of an entire connector like a RJ series connector.

U.S. Pat. Nos. 4,497,526, 4,647,136, 4,703,991, 4,786,259, 4,878,848, 4,878,858, 4,915,655, 5,035,641, 5,118,312, 5,378,172 and 5,702,271 indicate a prior low profile RJ connector which extends beyond a notch of a circuit board in a half-height thereof, or/and is diminished in the thickness of a wall of a plastic housing to form a cutout where a latch of a mating plug extends through. However, the lowered-profiles of these connectors are insufficient in applying with a thinner electrical device like a PCMCIA card for computer.

U.S. Pat. Nos. 5,183,404, 5,336,099, 5,338,210, 5,411,405 and 5,547,401 disclose another low profile RJ connector perpendicularly attached into the PCMCIA card. However, the vertical insertion of the RJ plug inside the RJ connector causes a protruded outgrowth of the entire assembled PCMCIA card.

U.S. Pat. Nos. 5,248,267, 5,562,504, 5,660,568, 5,773,332 and 5,938,480 disclose another low profile RJ connector which horizontally receives a mating RJ plug therein. The lowered profile of the RJ connector is still insufficient and lacks an EMI protection.

SUMMARY OF THE INVENTION

An objective of this invention is to provide an electrical connector assembly of which an insulative housing is integrally formed with a shielding shell.

Another objective of this invention is to provide the electrical connector assembly of which at least a portion of the shielding shell replace a wall of the housing thereby lowering the profile of the entire connector assembly.

Another objective of this invention is to provide the electrical connector assembly of which the housing forms at least holder section having a least thickness only enough to efficiently lock with a latch of an external plug connector thereby lowering the profile of the entire connector assembly.

Another objective of this invention is to provide an electrical connector assembly used for an electrical card of which a conductive shelter is insert-molded with the insulative housing of the connector assembly.

In order to achieve the object set forth, an ultra lower profile electrical connector assembly in accordance a first embodiment of the present invention for electrical connection with an external plug connector includes a conductive shell, an insulative housing and a plurality of contacts. The shell is made of a metal sheet to include a planar portion and two opposed and spaced extensions vertically extending from the planar portion. The housing is integrally and directly molded to the shell so that the extensions of the shell are respectively enclosed inside several vertical walls formed with the housing, and the planar portion of the shell is located flush with a first plane as an outermost surface of the vertical walls of the housing, and a horizontal wall integrally formed perpendicular to the vertical walls is spaced opposite to the planar portion of the shell. A receiving space is defined with the vertical and horizontal walls of the housing. A holder section located at a remote end of each vertical wall of the housing far away the horizontal has a least thickness beyond a second surface opposite to the first plane, only enough to efficiently lock with a latch of the external plug connector. Therefore, the profile of the entire connector assembly is reduced more than those of the prior arts.

A second embodiment in accordance with the present invention indicates that the connector assembly of the first embodiment is further attached into a circuit board where at least electric ship and plenty of circuit trances located thereon. Then, the connector assembly accompanying with the circuit board is packaged by an upper and lower conductive shelter to be a specific electrical card. Meanwhile, the planar portion of the shell electrically and mechanically contacts with the upper shelter.

A third embodiment in accordance with the present invention indicates that an upper shell for an electrical card is insert-molded by an insulative housing of a connector assembly.

According to one aspect of the invention, the protruded portion of the upper and lower shells flushes to the outer surface of the corresponding cover.

These and additional objects, features, and advantages of the present invention will become apparent after reading the following detailed description of the preferred embodiments of the invention taken in conjunction with the appended drawings.

DETAILED DESCRIPTION OF PREFERRED EMBODIMENT

Detailed reference will now be made to the preferred embodiments of the present invention.

Figure 1:
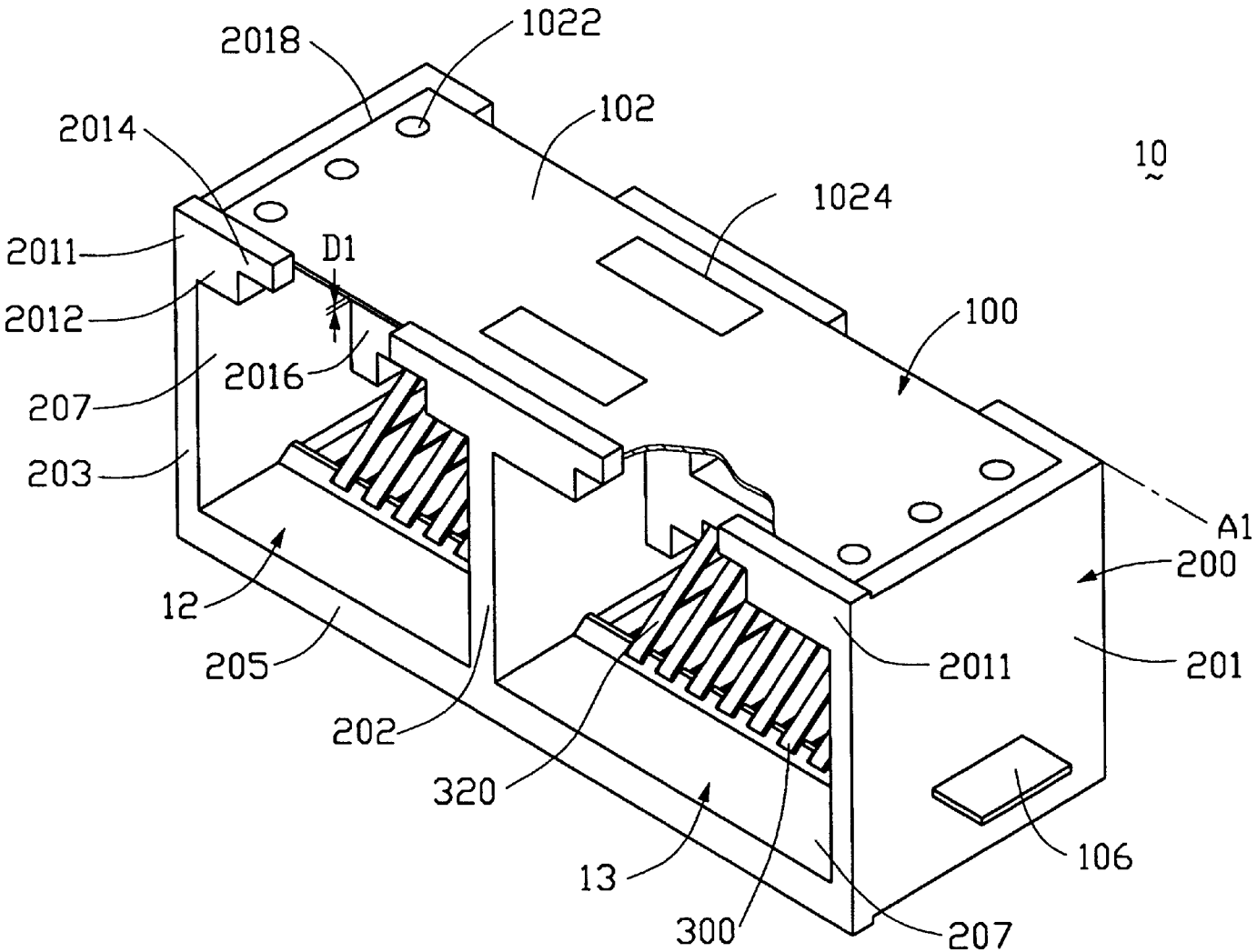
FIG. 1 is perspective view of an electrical connector assembly of a first preferred embodiment in accordance with the present invention exposing the inner of the connector assembly by means of removing a part of a shell.
Figure 8:
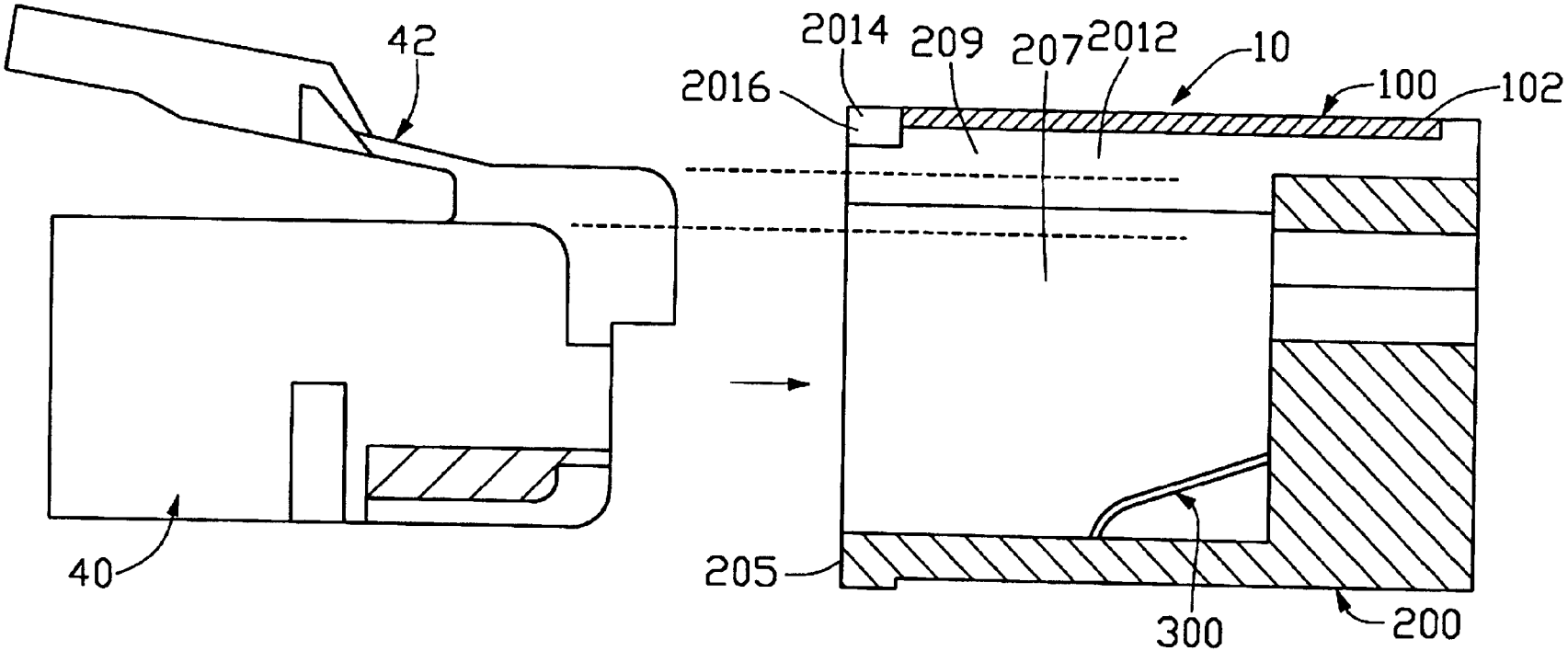
FIG. 8 is a cross-sectional view of the electrical connector assembly of FIG. 1 showing that an external plug connector is being inserted into the connector assembly.

Referring to a first preferred embodiment in accordance with the present invention shown in FIGS. 1 & 8, an ultra lower profile electrical connector assembly 10 consists of two different connectors 12, 13 like a RJ11 and RJ45 connectors for electrical connection with an external plug connector 40 having a latch 42, respectively. The electrical connector assembly 10 further includes a conductive shell 100, an insulative housing 200 and a plurality of contacts 300. The contacts 300 each consist of an engaging section 320 and a tail section (not shown).

Figure 3:
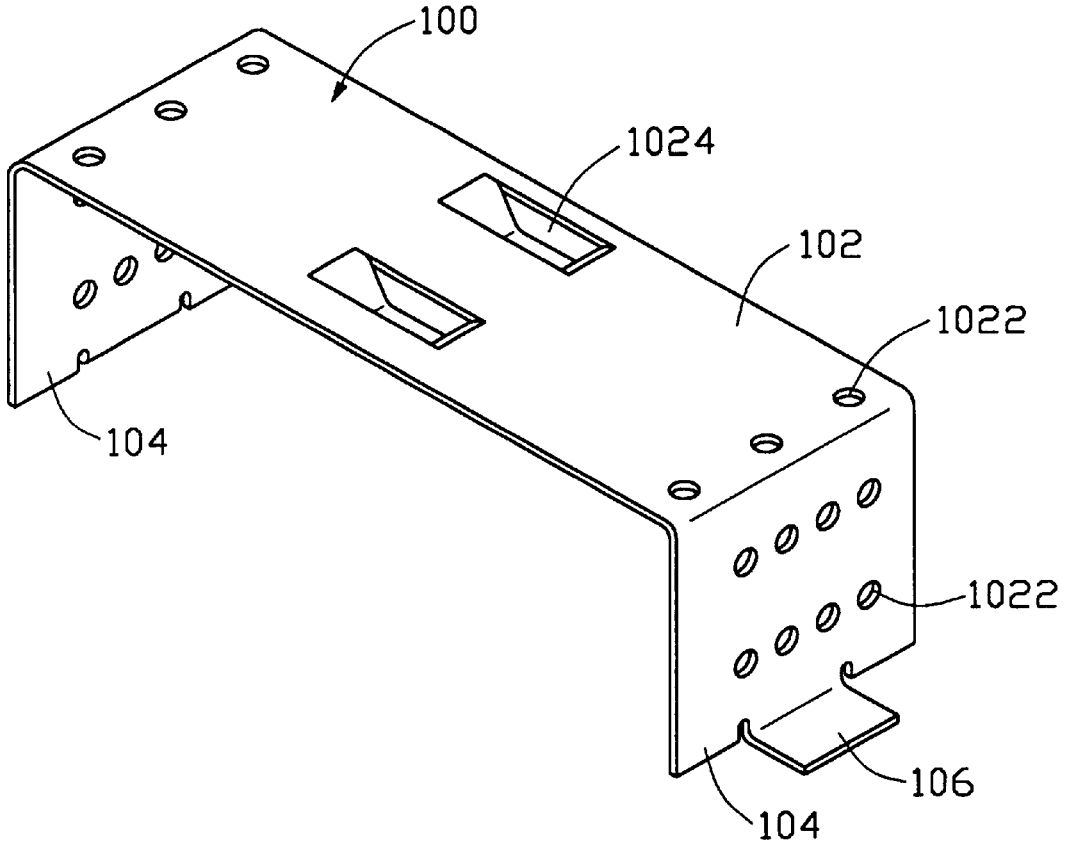
FIG. 3 is a perspective view of the shell used for the connector assembly shown in FIG. 1.

As shown in FIG. 3, the conductive shell 100 made of a thin metal sheet for electrically shielding the insulative housing 200, integrally forms a planar portion 102 and two opposed and spaced extensions 104 integrally connected with opposed edges of the planar portion 102 and vertically extending outward. A tab 106 horizontally and outwardly extends from an edge of each of the extensions 104. A plurality of through hole 1022 are defined around the conductive shell 100 as recited in claim 1 thereby permitting the vertical full influx of a few molding materials shaping the housing 200 by an insert-molding process for the combination of the shell 100 with the housing 200 as the result shown in FIG. 1. Similarly, a plurality of caves 1024 are defined through the planar portion 102 of the shell 100 thereby permitting the horizontal full influx of a few molding materials shaping the housing 200 during the insert-molding process for enhancement of the securement of the shell 100 to the housing 200 as the result shown in FIG. 1.

Figure 2:
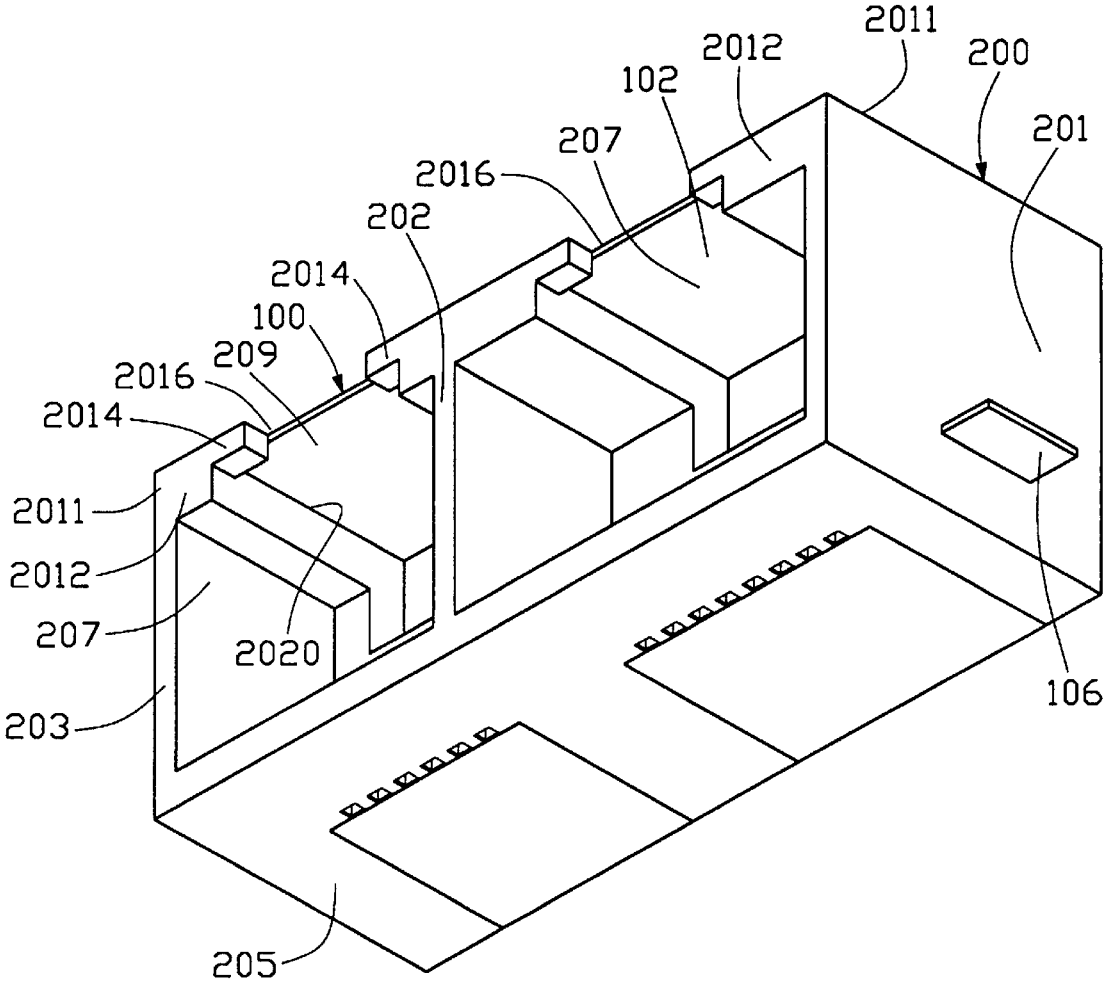
FIG. 2 is another perspective view of the electrical connector assembly shown in FIG. 1.

In integrally molding the insulative housing 200 to the shell 100 shown in FIGS. 1 & 2, the extension 104 of the shell 100 are enclosed inside one of several opposed and spaced vertical walls 201–203 formed with the housing 200, respectively. Meanwhile, the tabs 106 of the shell 100 protrude out of the corresponding vertical walls 201,203 of the housing 200. A horizontal wall 205 is integrally formed perpendicularly with the horizontal walls 201–203 of the housing 200 and is spaced parallel to the planar portion 102 of the shell 100. As the result, the planar portion 102 of the shell 100 is exposed outside a first pane as an outermost surface A1 of the housing 200 parallel to the horizontal wall 205 for fixedly securing the shell 100 to the housing 200. Therefore, the planar portion 102 and the extensions 104 of the shell 100 is capable to electrically shield the contacts disposed between the vertical walls 201–203 of the housing 200 but the extensions 104 are isolated from the contacts 300 by the vertical walls 201–203.

Further referring to FIGS. 1, 2 & 8, each of the vertical walls 201–203 has a remote end 2011 extending away from the horizontal wall 205 to reach the outermost surface A1 so that the planar portion 102 of the shell 100 is located flush with the outmost surface A1 of the housing 100 for lowering the profile of the entire electrical connector 10. A receiving space 207 is defined among each two of the opposed vertical walls 201–203 and the horizontal wall 205 of the housing 200 for receiving the electrical engagement of the mating plug connector 40 with the engaging sections 320 of the contacts 300. As seen, each two receiving space 207 are separated with each other by the vertical wall 202 for receiving different mating plug connector therein.

Figure 5:
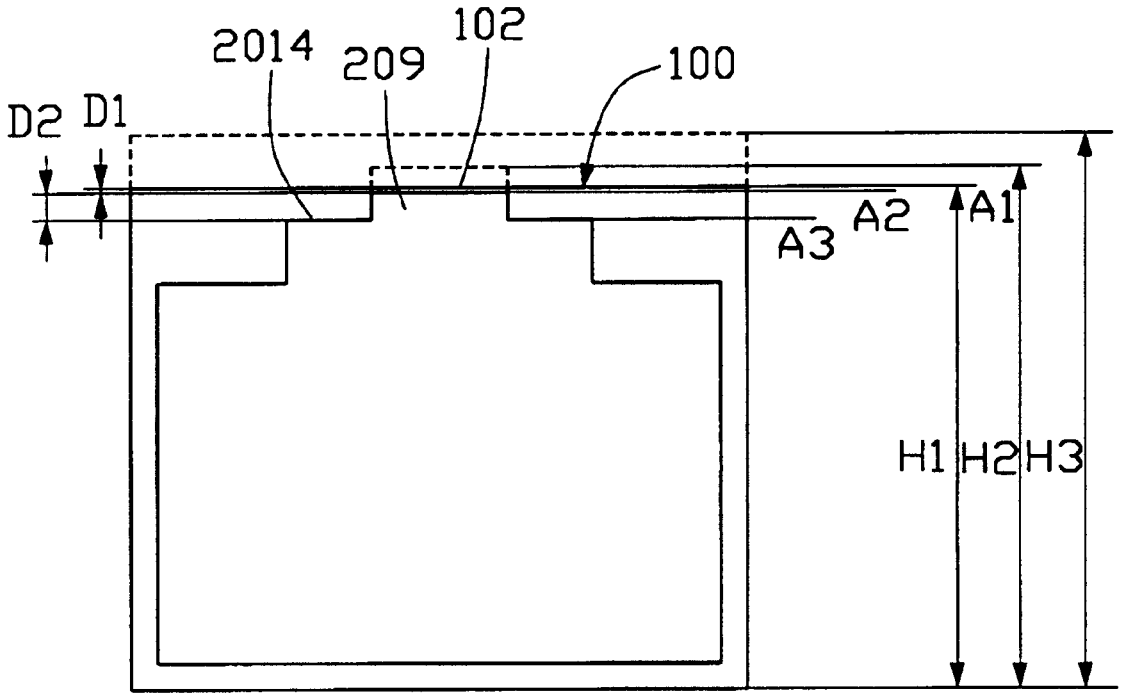
FIG. 5 is a schema of a front view of a RJ connector showing several planes of different levels.

A platform portion 2012 is laterally and horizontally formed with the remote end 2011 of each of the vertical walls 201–203 wherein the platform portions 2012 of each two of the opposed vertical walls 201–203 are fully separated apart from each other by a slot 209 which is defined at a plane A2 as shown in FIG. 5. A holder section 2014 horizontally extends from each platform portion 2012 of the vertical walls 201–203 to enter the slot 209 thereby locking with the latch 42 of the mating plug connector 40. A cutout 2016 is defined between the adjacent holder sections 2014 of each two of the opposite vertical walls 201–203 to permit that the latch 42 of the mating plug connector 40 protrudes out of the shell 100 after being inserted into the receiving space 207 of the housing 200. A seam 2018 is defined with each of the vertical walls 201–203 of the housing 200 thereby fixedly receiving the corresponding extension 104 of the shell 100 therein during the insert-molding process as above mentioned. Each of the platforms 2012 defines a notch 2020 with a depth equal to the thickness D1 of the planar portion 102 of the shell 100 for supporting one of several edges of the planar portion 102.

Understandably, the planar portion 102 of the shell 100 of the present invention substantially replaces a top wall of an insulative housing of the prior arts by the insert-molding process. Therefore, both shielding effect and structure of the entire electrical connector assembly 10 is strengthened, and the profile/height of the connector assembly is lowered more than those of the prior arts since the thickness of the metal shell 100 is thinner than that of a top wall of the insulative housing. The schema illustrated in FIG. 5 indicates three kinds of connectors with different heights H1, H2 & H3

(H3>H2>H1). A first type connector with a height H3 as disclosed in U.S. Pat. No. 4,647,136 does not have a cutout defined a top wall thereof. A second type connector with a height H2 as disclosed in U.S. Pat. No. 4,878,858 removes a part of the top wall from the housing to define a cutout, which is lower than the first type connector. A third type connector with a height H1 as the present invention completely removes a top wall from the housing 200 and remains only the holder sections 2014, which is lower than the second type connector 11. In the meantime, the holder section 2014 has a least thickness D2 extending beyond a plane A2 parallel to the first plane as the outermost surface A1 of the connector 10, only enough to efficiently lock with the latch 42 of the mating plug connector 40. And, an interval between the outermost surface A1 and the plane A2 is just equal to the thickness D1 of the planar portion 102 of the shell 100. Therefore, the profile/height of the entire connector can reach a lowest level in comparison with the other type connectors as presented in FIG. 5. As soon as extending into the slot 209 of the housing 200 via the cutout 2016, the latch 42 of the mating plug connector 40 shown in FIG. 8 can abut against a bottom surface of the planar portion 102 of the shell 100 as the plane A2 of FIG. 5.

Figure 4:
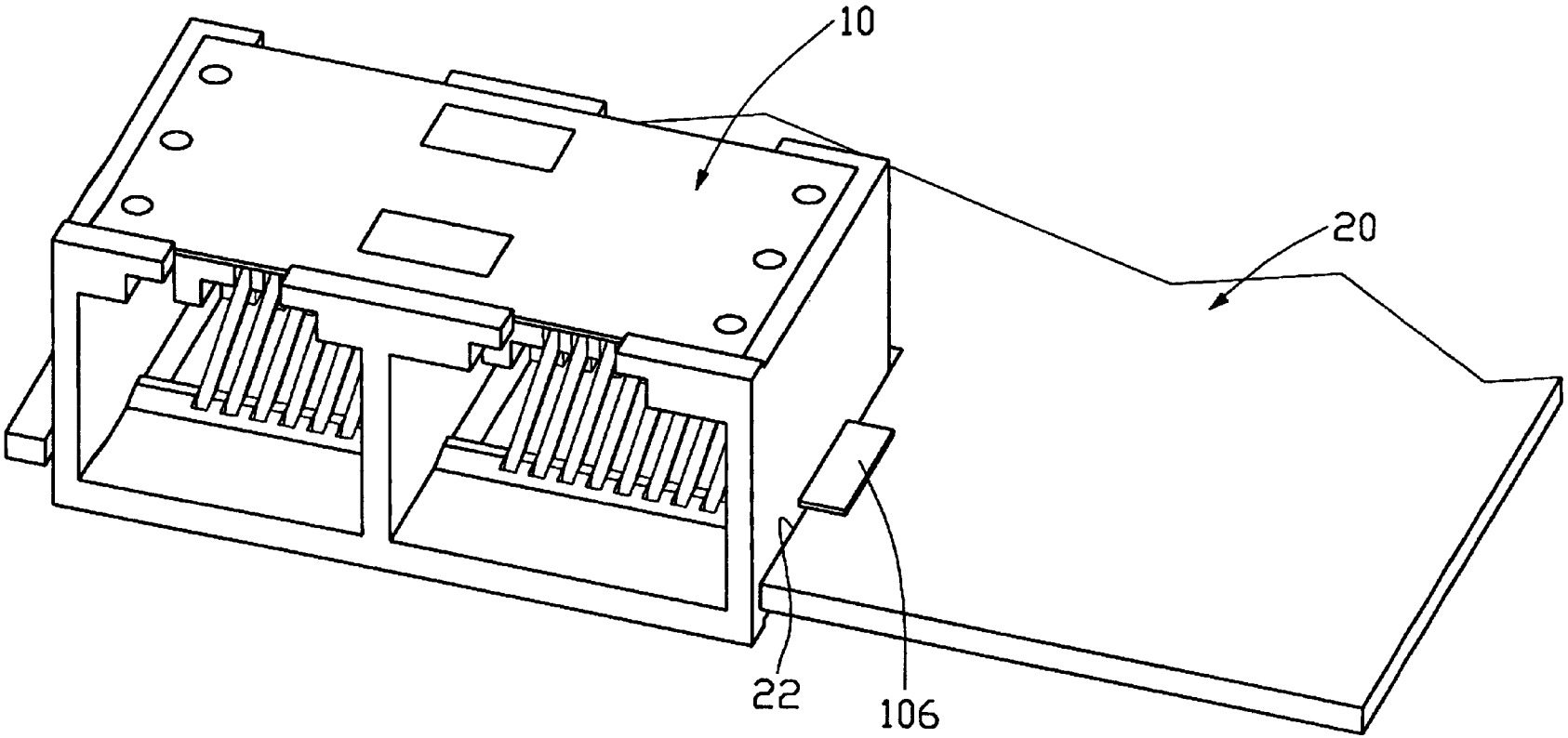
FIG. 4 is a perspective view of the electrical connector assembly of FIG. 1 mounted on a circuit board.

Referring to FIG. 4, the connector assembly 10 is steadily attached inside a notch 22 in front edge of a circuit board 20. Almost half-height of the connector assembly 10 is exposed beyond the circuit board 20 for lowering the total height after assembly, and the tabs 106 of the connector assembly 10 are respectively soldered with several pads (not shown) printed on the circuit board 20 for grounding protection. The circuit board 20 optionally includes at least an electrical chip (not shown) and plenty of circuit traces (not shown) located thereon to be connected with the pads.

Figure 6A:
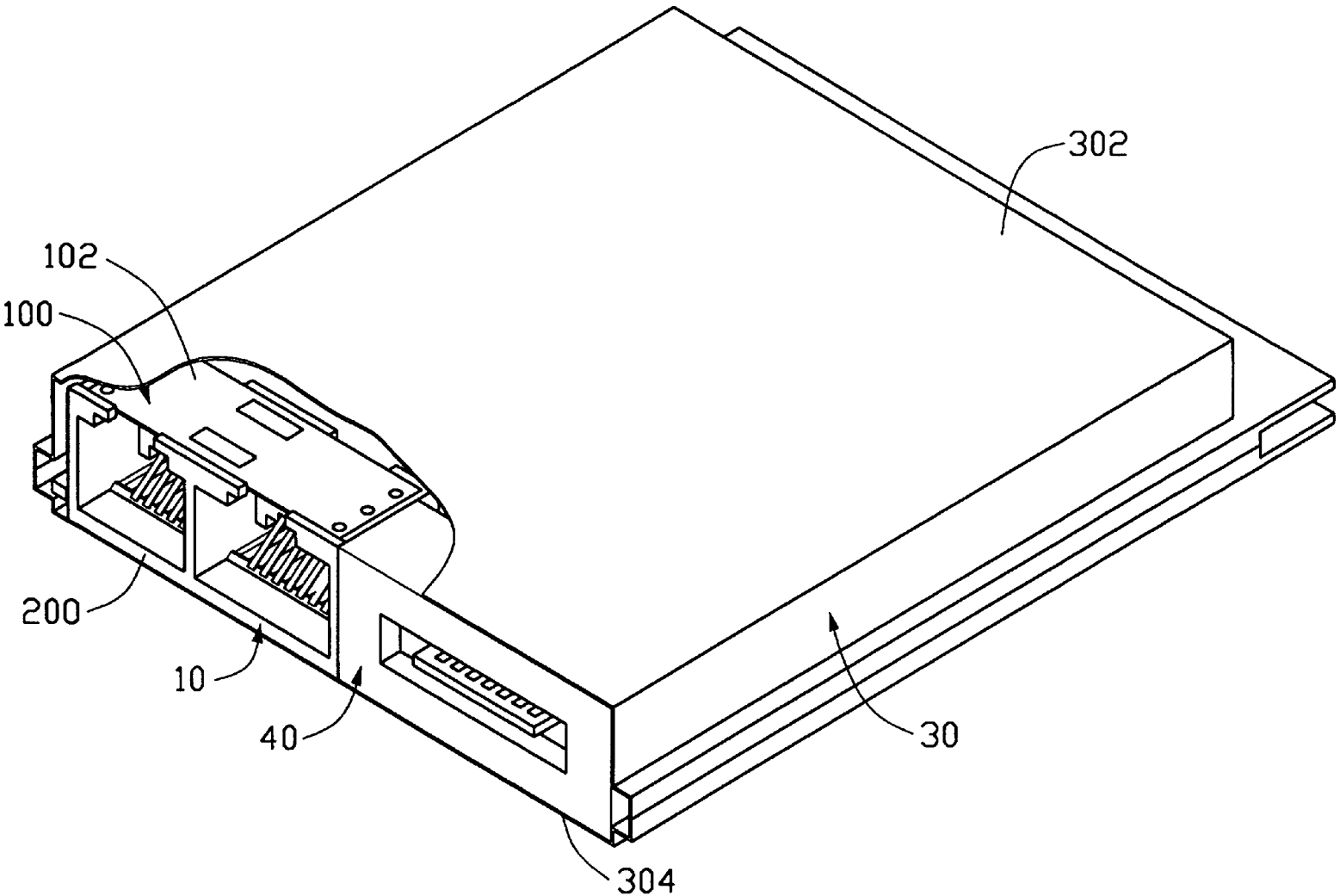
FIGS. 6A–6B are perspective views of an electrical connector assembly attached into an electrical card in accordance with a second preferred embodiment of the present invention.
Figure 6B:
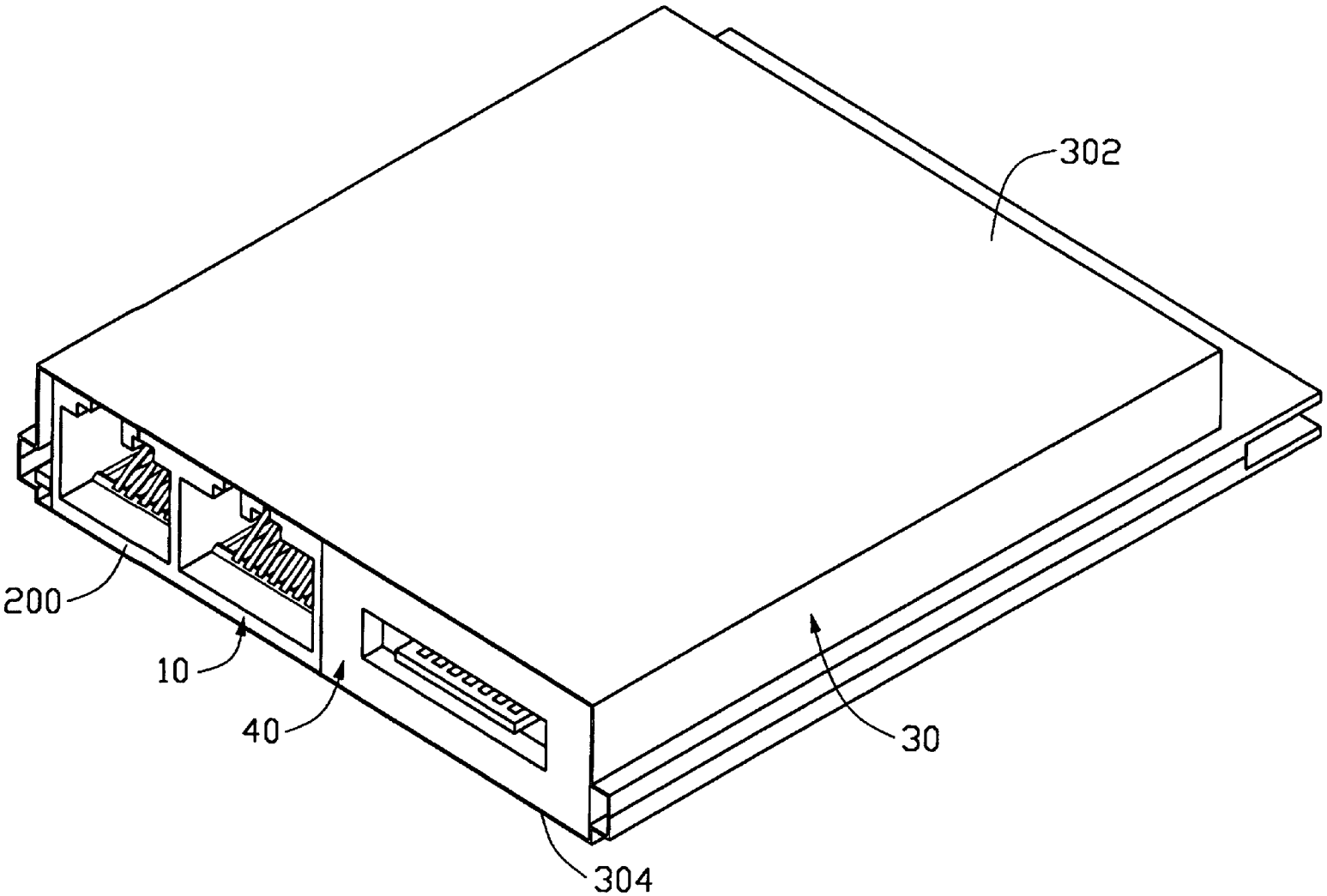

According to a second preferred embodiment of the present invention shown in FIG. 6A, the electrical connector assembly 10 and the circuit board 20 with electrical chip and the circuit traces, as shown FIG. 4, is further packaged by a upper and lower conductive shelters 302, 304 to be a specific electrical card 30. The planar portion 102 exposed outside the outermost surface of the electrical connector assembly 10 therefore electrically and mechanically contacts with the upper shelter 302 for better shielding protection to both of the connector assembly 10 and the circuit board 20. A standard D-shaped connector 40 is attached adjacent the electrical connector assembly 10. The result is shown in FIG. 6B.

Figure 7A:
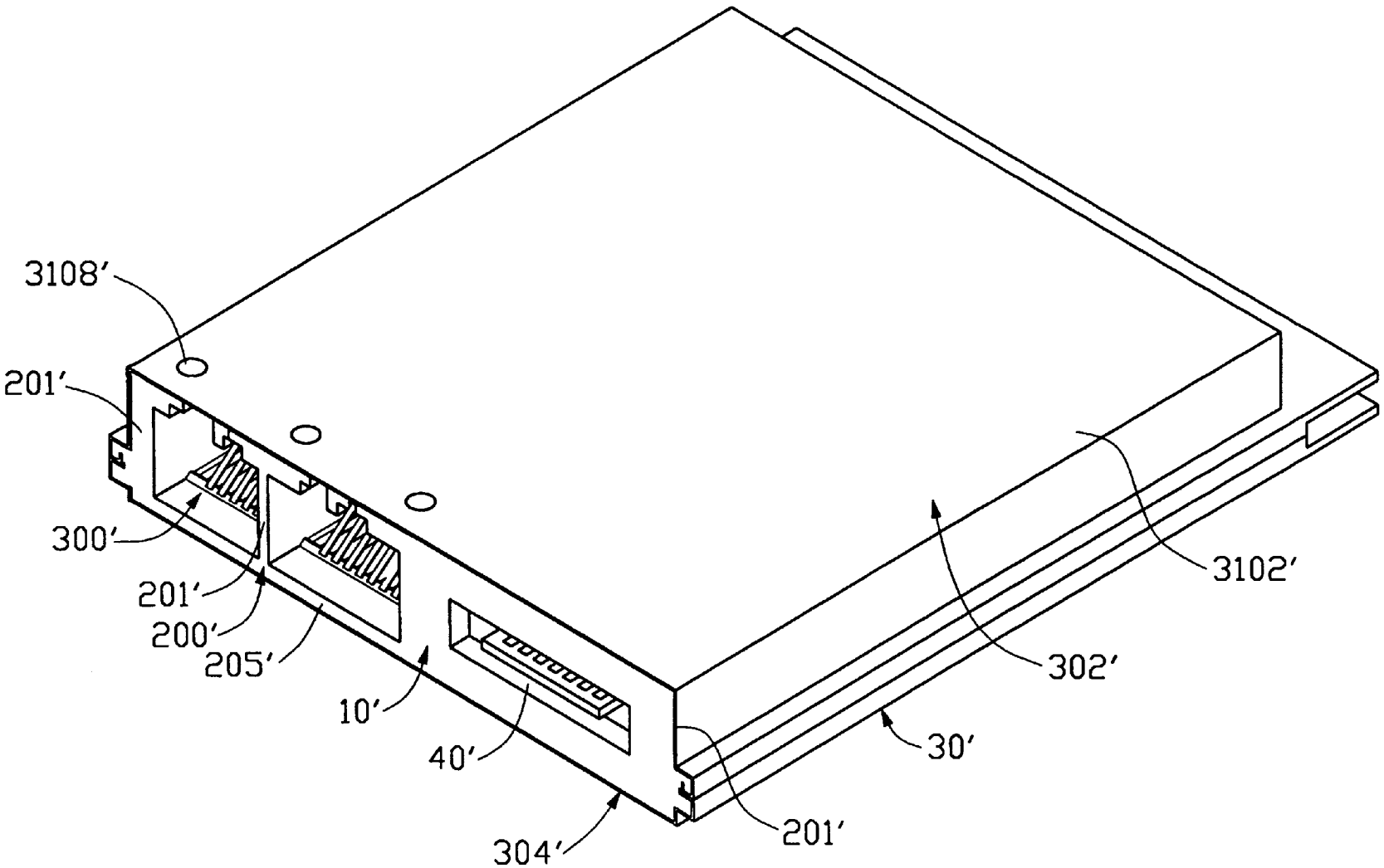
FIG. 7A is a perspective view of an electrical connector assembly integrally molded on a shell of an electrical card in accordance with a third preferred embodiment of the present invention.
Figure 7B:
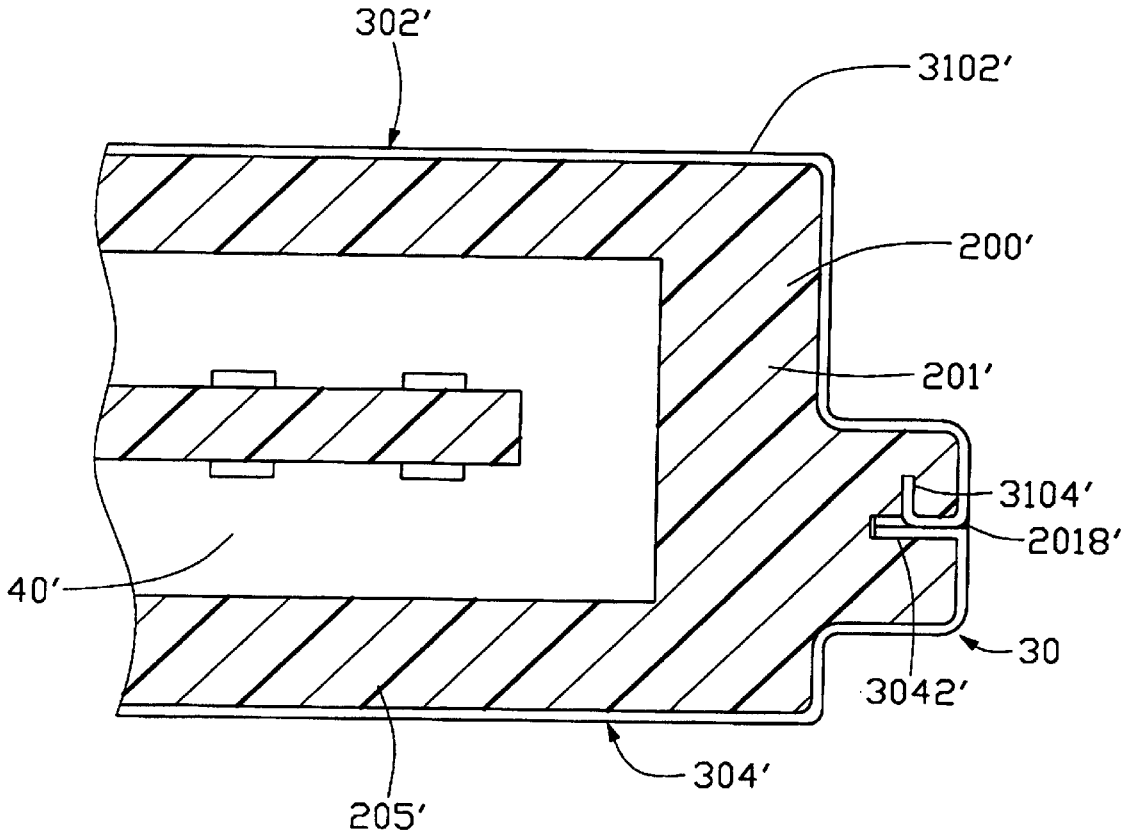
FIG. 7B is a partial cross-sectional view of the electrical card of FIG. 7A.

According to a third preferred embodiment of the present invention shown in FIGS. 7A & 7B, another upper conductive shell 302' for an electrical card 30' is made instead of the shelter 302 and the shell 100 of the second embodiment shown in FIG. 6A, including a planar portion 3102' and two opposite extensions 3104' integrally and angulary connected with the planar portion 3102'. Besides, an insulative housing 200' of the electrical connector assembly 10' like two RJ series connectors and a D-shaped connector is directly and integrally molded to the conductive shell 302' of the electrical card.30', consisting of a plurality of vertical walls 201' and a horizontal wall 205'. Meanwhile, each of the extensions 3104' of the upper shell 302' is angularly inserted inside a side of a seam 2108' defined one of the outermost vertical walls 201'. The other structures on the electrical connector assembly 10' like the contacts 300', the through hole 3108', and the platform portions and the slots on the vertical wall 201' are the same as the first and second embodiments. A circuit board as used in the second embodiment shown in FIG. 4 for transmitting electric signals of the electrical card 30' is then installed with the connector assembly 10' accompanying with the upper shell 302' by soldering process. Eventually, two wedges 3042' of a bottom shell 304' are respectively horizontally snapped into the seams 2108' of the vertical walls 201' of the housing 100' from a bottom of the connector assembly 10' to engages with the extensions 3104' of the upper shell 302', electrically and mechanically. The assembled result is shown in FIGS. 7A & 7B.

It is noted that although the planar portion 3102' of the upper shell 302' is located over an outermost upper surface of the housing 200' of the electrical connector assembly 10', a front part of the planar portion 3102' adjacent to the connector assembly 10' is capable of being optionally designated into a structure coplanar with the outermost upper surface of the housing 200' of the connector assembly 10' by insert-molding process, as good as the planar portion 102 of the first embodiment shown in FIG. 1.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector for electrical connection with a mating electrical connector having a latch, comprising:

an insulative housing integrally forming a horizontal wall, and two opposed and spaced vertical walls positioned normally of the horizontal wall, each vertical wall having at least a remote end away from the horizontal wall;

a plurality of contacts each having an engaging section and a tail section;

a receiving space defined between the vertical walls and the horizontal wall of the housing for allowing electrical engagement of the mating connector with the engaging sections of the contacts; and a shell made of a thin metal sheet integrally forming a planar portion located flush with an outmost surface of the remote end of each vertical wall and opposite to the horizontal wall of the housing thereby lowering the profile of the entire electrical connector;

wherein each of the vertical walls laterally defines a platform portion on the remote end thereof for supporting the planar portion of the shell;

wherein the platform portions of the opposed vertical walls are fully separated apart from each other by a slot defined at a plane parallel to the planar portion of the shell;

wherein the latch of the mating connector extends through the slot of the housing to abut against the planar portion of the shell during insertion into the receiving space of the housing;

wherein a holder section horizontally extends from each platform portion of the vertical wall toward the slot thereby locking with the latch of the mating connector;

wherein a cutout is defined between the adjacent holder sections of the opposite vertical walls to permit the latch of the mating connector to protrude out of the shell after being inserted into the receiving space of the housing;

wherein each of the platforms defines a notch with a depth equal to the thickness of the planar portion of the shell for receiving one of several edges of the planar portion therein.

* * * * *